US006918527B2

(12) United States Patent
Hakozaki et al.

(10) Patent No.: US 6,918,527 B2
(45) Date of Patent: Jul. 19, 2005

(54) STAPLE CARTRIDGE OF ELECTRIC STAPLER

(75) Inventors: Katsuya Hakozaki, Tokyo (JP); Hiroshi Sato, Tokyo (JP); Nobuaki Yagi, Tokyo (JP); Toshio Simizu, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/487,262

(22) PCT Filed: Aug. 22, 2002

(86) PCT No.: PCT/JP02/08481

§ 371 (c)(1),
(2), (4) Date: Feb. 20, 2004

(87) PCT Pub. No.: WO03/018267

PCT Pub. Date: Mar. 6, 2003

(65) Prior Publication Data

US 2004/0211811 A1 Oct. 28, 2004

(30) Foreign Application Priority Data

Aug. 23, 2001 (JP) ..... P. 2001-253527
Aug. 23, 2001 (JP) ..... P. 2001-253529

(51) Int. Cl.[7] ..... B25C 5/16

(52) U.S. Cl. ..... 227/131; 227/120; 227/128; 227/155

(58) Field of Search ..... 227/2, 120, 131, 227/136, 127, 128, 123, 109, 155

(56) References Cited

U.S. PATENT DOCUMENTS 5,273,199 A * 12/1993 Logtens ..... 227/87
5,560,529 A * 10/1996 Udagawa et al. ..... 227/136
5,823,415 A * 10/1998 Udagawa et al. ..... 227/120
5,836,502 A * 11/1998 Kanai et al. ..... 227/131
6,039,230 A * 3/2000 Yagi et al. ..... 227/120
6,536,646 B1 * 3/2003 Pinczewski et al. ..... 227/5
6,557,744 B2 * 5/2003 Kitamura ..... 227/119
6,568,579 B2 * 5/2003 Mochizuki ..... 227/131
6,634,536 B2 * 10/2003 Yoshie ..... 227/131
6,715,654 B2 * 4/2004 Sugihara et al. ..... 227/2

FOREIGN PATENT DOCUMENTS

JP 61-112870 U 7/1986
JP 62-184991 U 11/1987
JP 4-54683 U 5/1992
JP 4-115582 U 10/1992

* cited by examiner

*Primary Examiner*—Scott A. Smith
(74) *Attorney, Agent, or Firm*—Morgan, Lewis & Bockius LLP

(57) ABSTRACT

A staple cartridge includes: a cartridge body for accommodating a large number of staples; and a face plate provided at a front end portion of the cartridge body, for forming a striking passage (211) of striking a staple by a driver, wherein support pieces are integrally formed from both side edges of the face plate to the rear, engaging bosses formed in the support pieces are engaged with recess portions formed on both sides of the front end portion of the cartridge body (206), and the face plate is slidably and pivotally supported by the cartridge body (206). In the cartridge body (206) and cover (209), the small thickness grooves (215), (216), by which the staple cartridge (204) is bent into two pieces, are formed on the circumference of the staple accommodating portion.

2 Claims, 7 Drawing Sheets

STAPLE CARTRIDGE OF ELECTRIC STAPLER

TECHNICAL FIELD

The present invention relates to a staple cartridge for an electric stapler, in which a large number of staples are accommodated, detachably attached to the electric stapler body. The present invention also relates to a staple cartridge for an electric stapler having a face plate on which a striking passage for striking staples is formed.

BACKGROUND ART

In an electric stapler for successively striking staples, which are charged into a magazine, by driving a driver with a motor, the following cartridge type electric stapler is well known. In order to make it easy to charge staples into the magazine, a staple cartridge which accommodates a large number of staples is attached to the magazine of the electric stapler, and the staples in the staple cartridge are successively stricken by the driver so that binding can be accomplished by the staples.

The staple cartridge includes: an accommodating portion for accommodating a large number of staples; and a striking passage for striking a staple at the head of the staples toward sheets of paper to be bound. This striking passage is formed between the front wall of the accommodating portion and the face plate attached to the front end portion of the magazine. The staple cartridge further includes: a cartridge body composing the above accommodating portion for accommodating the large number of staples; the large number of staples accommodated in the accommodating portion; a leaf spring for pushing the staples to one side of the accommodating portion; and a cover member for closing the opening of the accommodating portion.

A forming plate reciprocated by the motor and a driver, both provided on the stapler body side, enter the striking passage of the staple cartridge, and form the staples facing the striking passage into a C-shape, and strike the staples. And then, leg portions of the staple penetrating sheets of paper are bent by a clincher.

However, in the stapler described above, the thickness of sheets of paper to be bound is restricted by the size of staple to be used. Therefore, the following problems may be sometimes caused. In the case of sheets of paper, the thickness of which is larger than the restricted thickness, it is impossible for the leg portions of the staple, which has been stricken out from the striking passage by the driver, to penetrate the sheets of paper to be bound. Therefore, the stricken staple is buckled and jammed in the striking passage. When this problem is caused, in order to remove the jammed staple from the striking passage, it is necessary to move or turn the face plate so that the striking passage can be released. In the conventional cartridge, since the face plate is pivotally attached to the forward end portion of the staple cartridge, when the face plate is turned to remove the jammed staple with a finger, the finger may be contacted with an end portion of the staple and may be injured. Further, in the above conventional structure, it is necessary to provide a fulcrum shaft for supporting the face plate, and it is also necessary to provide a mechanism for holding this fulcrum shaft. Therefore, the structure of the conventional cartridge is complicated. This type staple cartridge is designed so that the staple cartridge is discarded after the staples accommodated in the cartridge have been consumed. Therefore, the manufacturing cost of the cartridge having the above complicated structure is raised.

Furthermore, in the electric stapler in which the above cartridge is used, after the staples in the staple cartridge have been consumed, the staple cartridge itself is replaced so as to supply the staples. Therefore, the staple cartridge is made of inexpensive plastics of low manufacturing cost, and after the staples have been consumed, the staple cartridge is discarded. However, in the accommodating portion of the staple cartridge, a sheet-shaped spring piece made of metal for pushing the staples is accommodated together with the staples. Accordingly, when the staple cartridge is discarded, it is necessary to classify the spring piece made of metal and discard or recycle it. However, in the conventional staple cartridge, the staple accommodating portion is fixed and integrated with the cover. Therefore, in order to pick up the spring piece accommodated inside the staple cartridge, it is necessary to break the staple cartridge, which requires a tool. This work to pick up the spring piece is complicated and dangerous. For the above reasons, the spring piece accommodated inside the staple cartridge is not classified to be recovered or discarded. Accordingly, it is impossible for the conventional staple cartridge to use resources effectively and contribute to the prevention of environmental destruction in the case of discarding the used staple cartridge.

SUMMARY OF THE INVENTION

It is a first object of the present invention to provide a staple cartridge characterized in that: jammed staples, which are jammed in the staple striking passage, can be safely and easily removed; and the structure of the staple cartridge is simple as a disposable cartridge, and the manufacturing cost of the staple cartridge is low.

It is a second object of the present invention to provide a staple cartridge characterized in that: the spring piece in the accommodating portion can be easily removed from the staple magazine, the staples of which have been consumed, without using a tool, so that the staple cartridge can be easily classified and recovered or discarded.

In order to accomplish the first object described above, the staple cartridge of the present invention includes: a cartridge body for accommodating a large number of staples; a face plate made of plastics arranged at the front end portion of the cartridge body, on which a staple striking passage for striking the staples by a driver is formed; and support pieces integrally formed from both side edges of the face plate to the rear, wherein bosses formed in the support pieces are engaged with recess portions formed in both side faces of the front end portion of the cartridge body, so that the face plate is slidably and pivotally supported by the cartridge body.

In order to accomplish the second task described above, the staple cartridge of the present invention includes: a cartridge body in which an accommodating portion for accommodating a large number of staples is formed; staples accommodated in the accommodating portion; a leaf spring for pushing the staples to one side of the accommodating portion; and a cover for closing an opening of the accommodating portion, wherein a small thickness groove, by which the staple cartridge can be broken into two pieces, is formed on the circumference of the accommodating portion of the cartridge body and cover.

Figure 1:
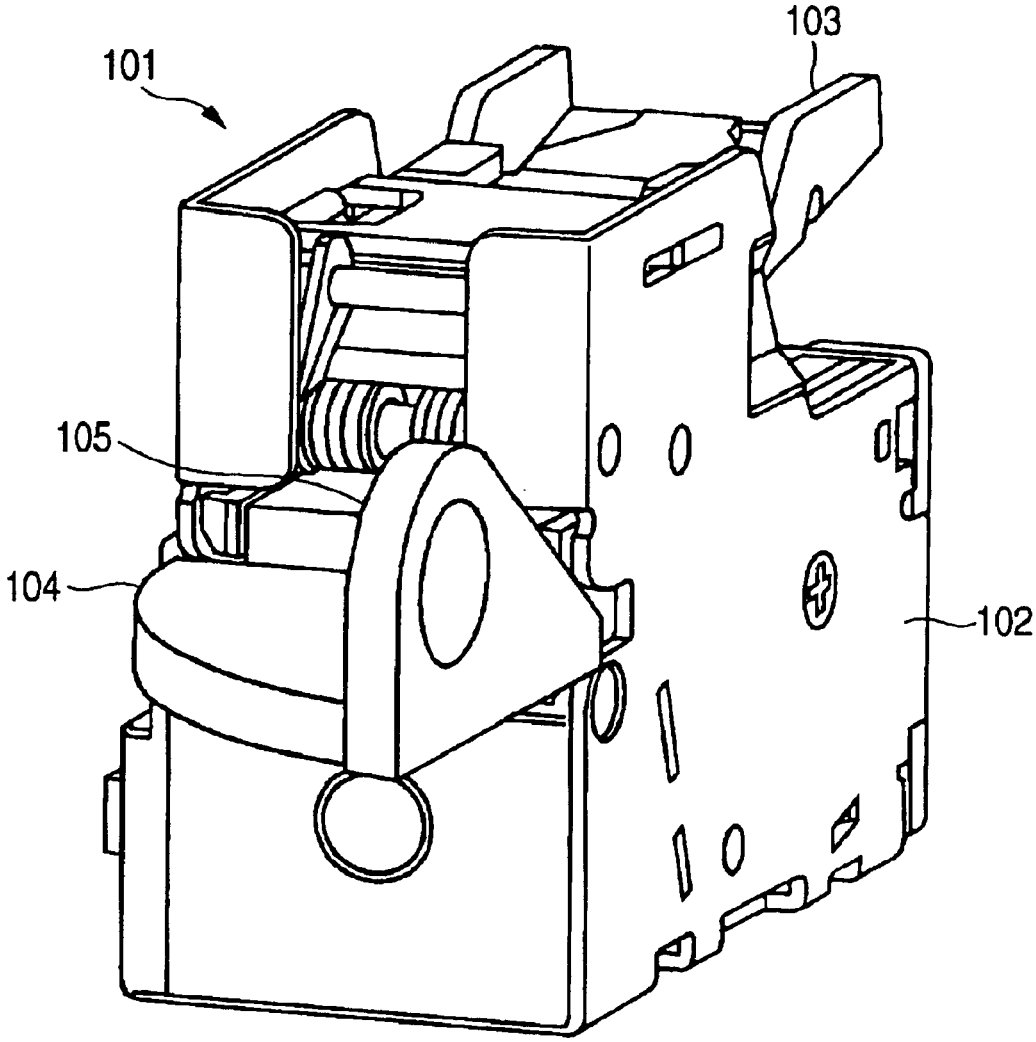
FIG. 1 is a perspective view of the electric stapler to which the staple cartridge of the present invention is attached.

Note that in the drawings, reference numeral 101 denotes an electric stapler, reference numeral 102 is a frame, reference numeral 103 is a clincher arm, reference numeral 104 is a staple cartridge, reference numeral 105 is a knob, reference numeral 106 is a cartridge body, reference numeral 107 is sheet staples, reference numeral 108 is a leaf spring, reference numeral 109 is a cover, reference numeral 110 is a face plate, reference numeral 111 is a striking passage, reference numeral 112 is a support piece, reference numeral 113 is an engaging boss, reference numeral 114 is a recess portion, reference numeral 115 is a protruded line, reference numeral 201 is an electric stapler, reference numeral 204 is a staple cartridge, reference numeral 206 is a cartridge body, reference numeral 207 is a sheet staple, reference numeral 208 is a spring piece, reference numeral 209 is a cover, reference numeral 210 is an accommodating portion, reference numeral 215 is a small thickness groove, reference numeral 216 is a small thickness groove, and reference numeral 217 is a reinforcing rib.

DESCRIPTION OF THE PREFERRED EMBODIMENTS

Referring to the embodiment shown in the drawings, the first embodiment of the present invention will be explained below. FIG. 1 is a view showing an electric stapler to which the staple cartridge of the present invention is attached. The electric stapler of this embodiment is incorporated into an apparatus such as a copying machine, printer or facsimile. A predetermined number of sheets of paper, which have been copied, printed or received by facsimile, are automatically stapled by this electric stapler of the built-in type. The electric stapler 101 includes: an electric motor arranged in a lower portion of the frame 102, which is a drive source of the electric stapler 101; a driver driven by the electric motor; and a forming plate for forming the staples. In an upper portion of the frame 102, the clincher arm 103 is pivotally supported, which bends leg portions of the staple that has penetrated sheets of paper to be bound when the staple has been stricken by the driver.

Figure 2:
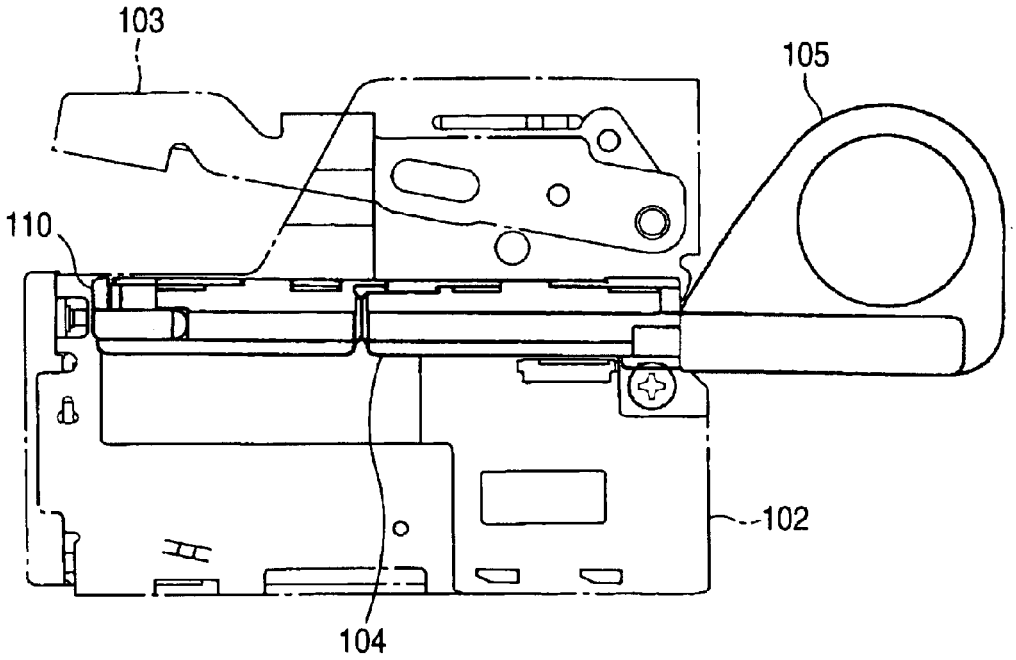
FIG. 2 is a side view of the staple cartridge of the same embodiment.
Figure 3:
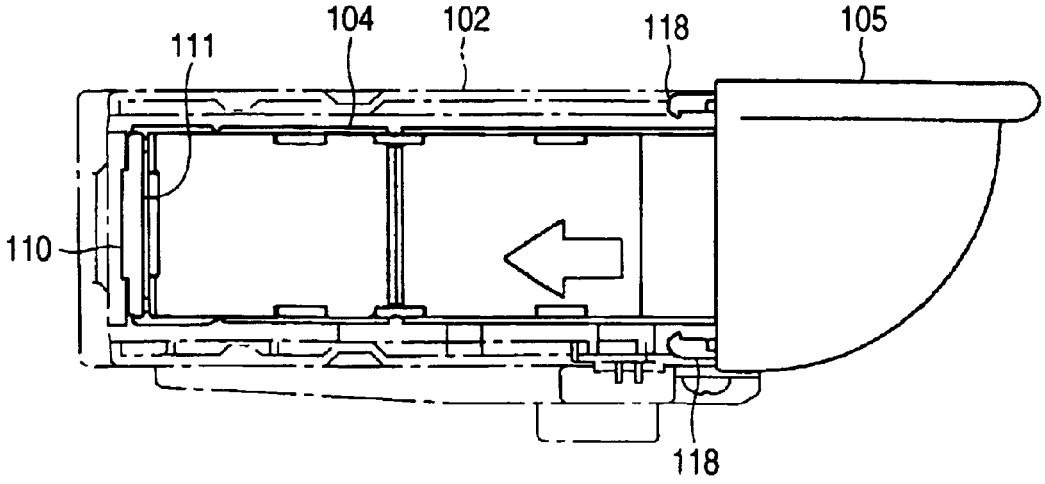
FIG. 3 is an upper view of the staple cartridge of the same embodiment.
Figure 4:
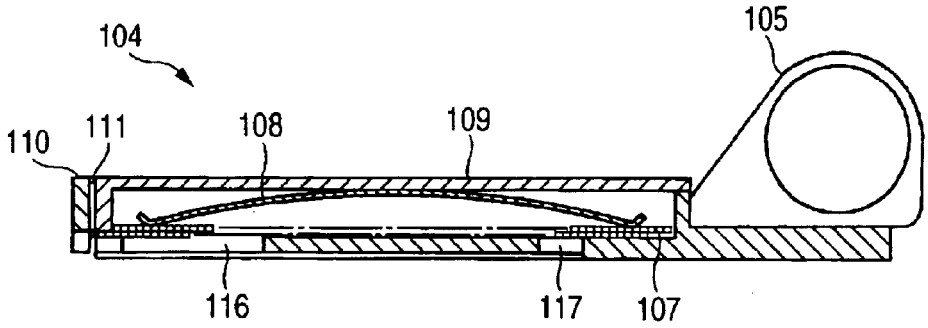
FIG. 4 is a longitudinally sectional side view of the staple cartridge of the present invention.
Figure 5:
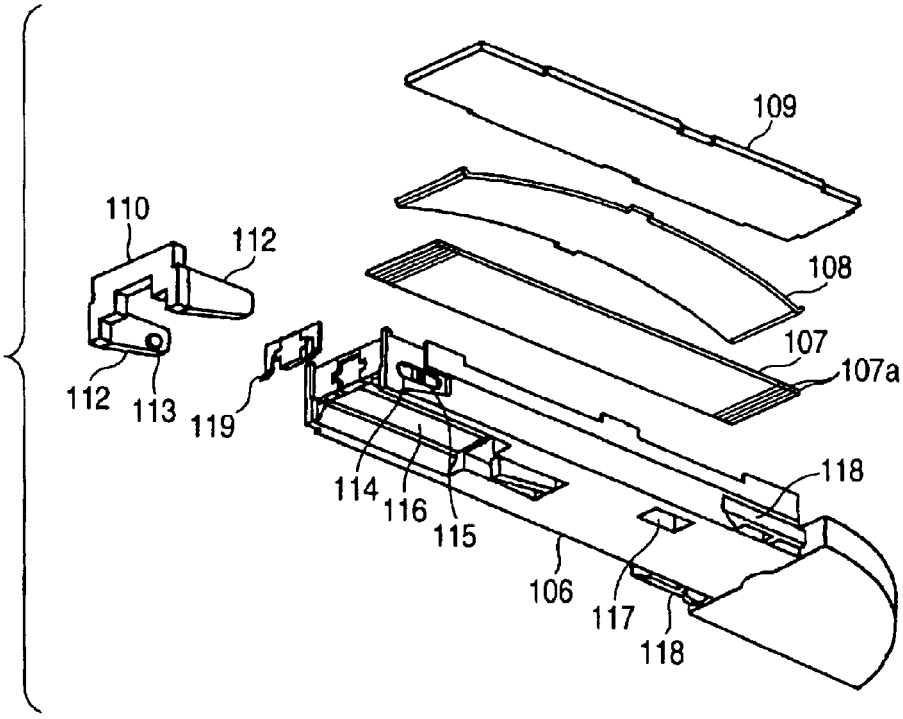
FIG. 5 is an exploded perspective view of the staple cartridge of the present invention.

As shown in FIGS. 2 and 3, the staple cartridge 104 is inserted into the magazine, which is formed between the clincher arm 103 and the driver, from the rear of the frame 102. At the rear end portion of the staple cartridge 104, the knob 105, which is used for attaching the staple cartridge 104 to the frame 102 or detaching the staple cartridge 104 from the frame 102, is arranged being exposed from the frame 102. As shown in FIGS. 4 and 5, the staple cartridge 104 includes: a cartridge body 106, the cross section of which is formed into a substantial C-shape; plane-shaped sheet staples 107 in which a large number of linear staple materials 107*a*, to be accommodated in the cartridge body 106, are arranged and bonded to each other; a leaf spring 108 for pushing the sheet staples 107 to the bottom portion of the cartridge body 106; and a cover 109 for closing the opening formed on the upper face.

In this connection, in this embodiment, the staple materials 107*a* charged into the staple cartridge 104 are formed into a linear shape which is a shape before the staple materials 107*a* are formed into the C-shape. The linear staple materials 107*a* are formed into the C-shape immediately before stricken out by the driver onto sheets of paper to be bound. In this connection, in the drawing, reference numeral 116 is an opening formed in the bottom portion of the cartridge body 106 so that the pawl of the feeding mechanism for supplying forward the sheet staples 107, which are accommodated in the cartridge body 106, can be engaged with the lower face of the sheet staples 107 in the cartridge. Reference numeral 117 is an opening for engaging the detector, which detects the existence of the sheet staples in the cartridge, with the sheet staples 107. Reference numeral 118 is a hook for fixing the staple cartridge 104 under the condition that the staple cartridge 104 is attached to the frame 102 of the electric stapler. Reference numeral 119 is a check pawl for preventing the sheet staples 107, which are conveyed to the left in the cartridge body 106 in FIG. 5, from being reversed.

At the front end portion of the staple cartridge 104, the face plate 110 is provided, on which the striking passage 111 is formed, for guiding the staples stricken out by the driver from the staple cartridge 104 toward sheets of paper to be bound, in cooperation with the front wall of the cartridge body 106. The face plate 110 is engaged with the front end side face of the cartridge body 106 by the support pieces 112, which are integrally formed from both side edges of the face plate 110 toward the rear, and by the engaging bosses 113 which protrude inward from the end portions of both support pieces 112. On both sides of the front end portion of the cartridge body 106, the recess portions 114 are formed in the longitudinal direction corresponding to the support pieces 112. On the bottom face of the central portion of the recess portion 114, the protruded line 115, which is formed in the longitudinal direction so that the recess portion can be divided into the front and the rear recess portion, is formed swelling from the bottom face. When the engaging bosses 113 of both support pieces 112 of the face plate 110 are accommodated in the recess portion 114 of the cartridge body 106, the face plate 110 can be slidably and pivotally combined with the cartridge body 106.

Figure 6:
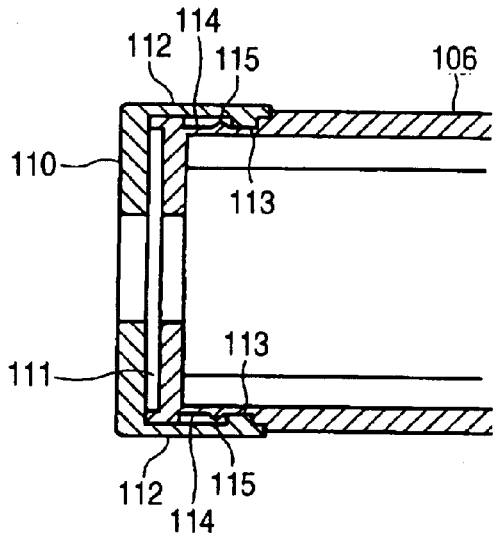
FIG. 6 is a laterally sectional plan view of the primary portion of the staple cartridge in which the face plate is normally arranged.
Figure 7:
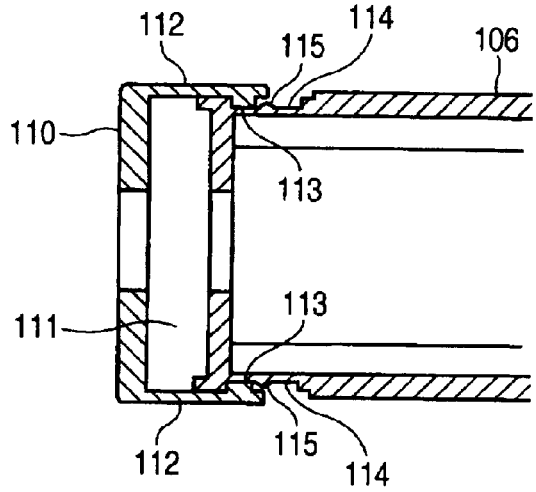
FIG. 7 is a laterally sectional plan view, which is the same as FIG. 6, in which the face plate is slid.
Figure 8:
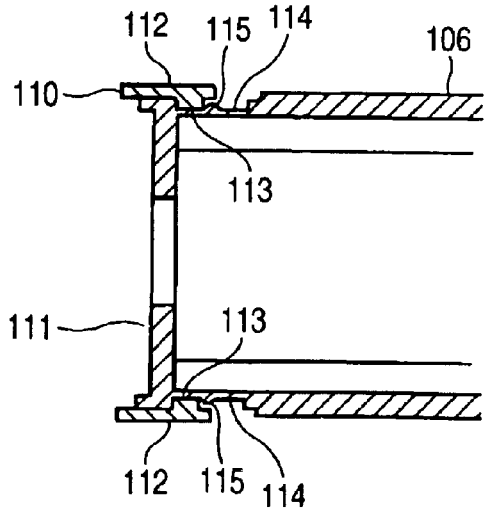
FIG. 8 is a laterally sectional plan view, which is the same as FIG. 6, in which the face plate is turned from the state shown in FIG. 7.

As shown in FIG. 6, when the staple cartridge 104 is attached to the electric stapler 101, the engaging boss 113 formed in the support piece 112 of the face plate 110 is arranged on the rear end side (on the right in FIG. 6) of the protruded line 115 in the recess portion 114 of the cartridge body 106. In this state, the striking passage 111 is appropriately formed by the face plate 110 and the front wall of the cartridge body 106. In the case where a staple is jammed in the striking passage 111, the staple cartridge 104 is drawn out from the frame 102 of the electric stapler 101, and the engaging boss 113 of the support piece 112 of the face plate 110 is slid and the engaging boss 113 gets over the protruded line 115 as shown in FIG. 7, and the engaging boss 113 is arranged on the front side (on the left in FIG. 7) of the recess portion 114. In this way, the face plate 110 is drawn forward from the cartridge body 106, so that the striking passage 111 can be opened. Successively, when the face plate 110 is turned round the engaging boss 113 as shown in FIG. 8, the front face of the striking passage 111 is opened. Therefore, the jammed staple remaining in the striking passage 111 can be easily removed. Since the face plate 110 is made of plastics, the face plate 110 is elastic. Therefore, only when the face plate 110 is lifted upward in the state shown in FIG. 6, the engaging boss automatically gets over the protruded line 115, and the face plate 110 is turned into the state shown in FIG. 8.

Figure 9:
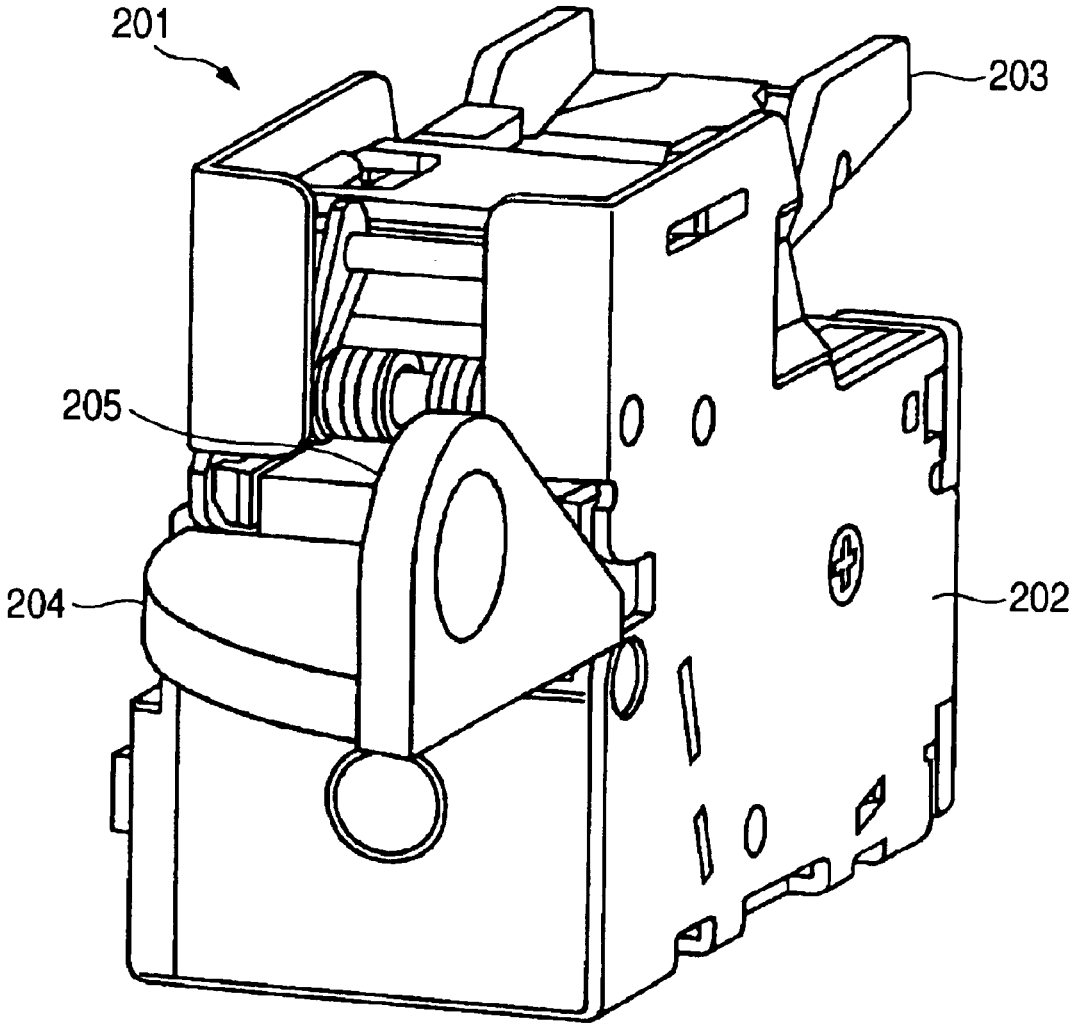
FIG. 9 is a perspective view of the electric stapler to which the staple cartridge of the present invention is attached.

Next, referring to the embodiment shown in the drawings, the second embodiment of the present invention will be explained below. FIG. 9 is a view showing an electric stapler to which the staple cartridge of the present invention is attached. The electric stapler of this embodiment is incorporated into an apparatus such as a copying machine, printer or facsimile, and a predetermined number of sheets of paper, which have been copied, printed or received by facsimile, are automatically stapled by this electric stapler of the built-in type. The electric stapler 201 includes: an electric motor arranged in a lower portion of the frame 202, which is a drive source of the electric stapler 201; a driver driven by the electric motor; and a forming plate for forming the staples into a C-shape. In an upper portion of the frame 202, the clincher arm 203 is pivotally supported, which bends leg portions of the staple that has penetrated sheets of paper to be bound when the staple has been stricken by the driver.

Figure 10:
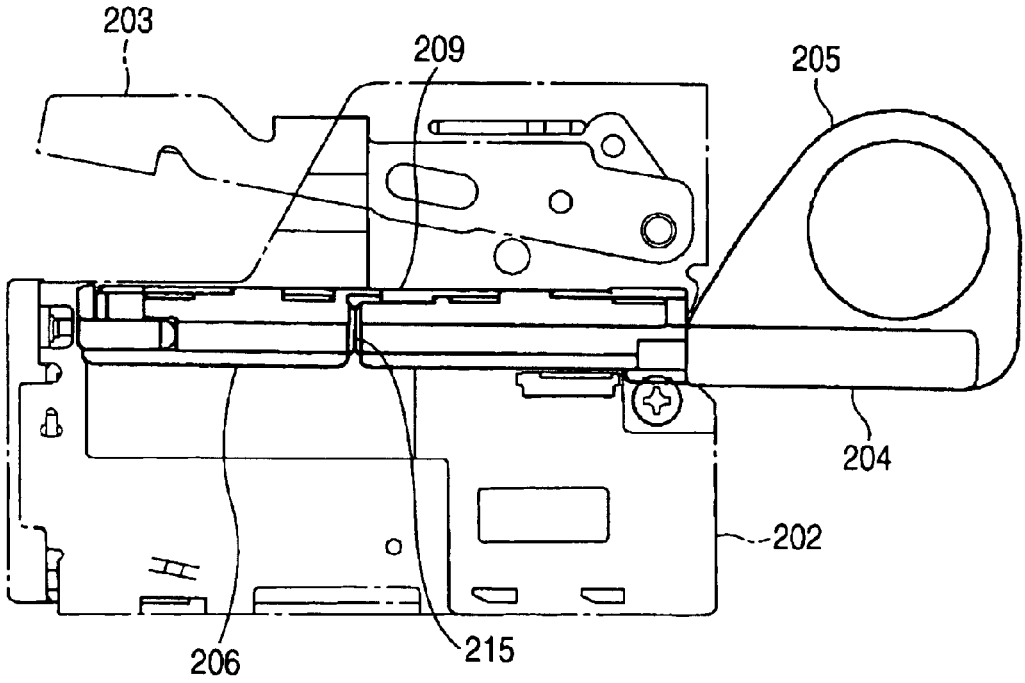
FIG. 10 is a side view of the staple cartridge of the same embodiment.
Figure 11:
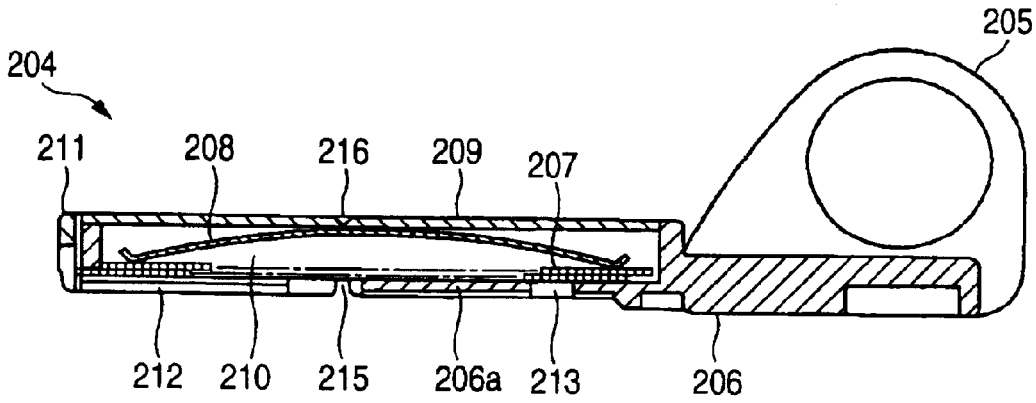
FIG. 11 is a longitudinally sectional side view of the staple cartridge of the present invention.

As shown in FIG. 10, the staple cartridge 204, in which a large number of staples are accommodated, is inserted into the magazine, which is formed between the clincher arm 203 and the driver, from the rear of the frame 202. At the rear end portion of the staple cartridge 204, the knob 205, which is held by an operator so that the staple cartridge 204 can be attached to the frame 202 or detached from the frame 202, is arranged being exposed from the frame 202. As shown in FIG. 11, the staple cartridge 204 includes: a cartridge body 206, the cross section of which is formed into a substantial C-shape so that the cartridge body 206 forms the staple accommodating portion 210; sheet staples 207 in which a large number of linear staple materials accommodated in the accommodating portion 210 in the cartridge body 206 are arranged and bonded to each other; a leaf spring 208 made of metal for pushing the sheet staples 207 to the bottom portion of the accommodating portion 210 of the cartridge body 206; and a cover 209 for closing the opening formed on the upper face of the accommodating portion 210.

Figure 12:
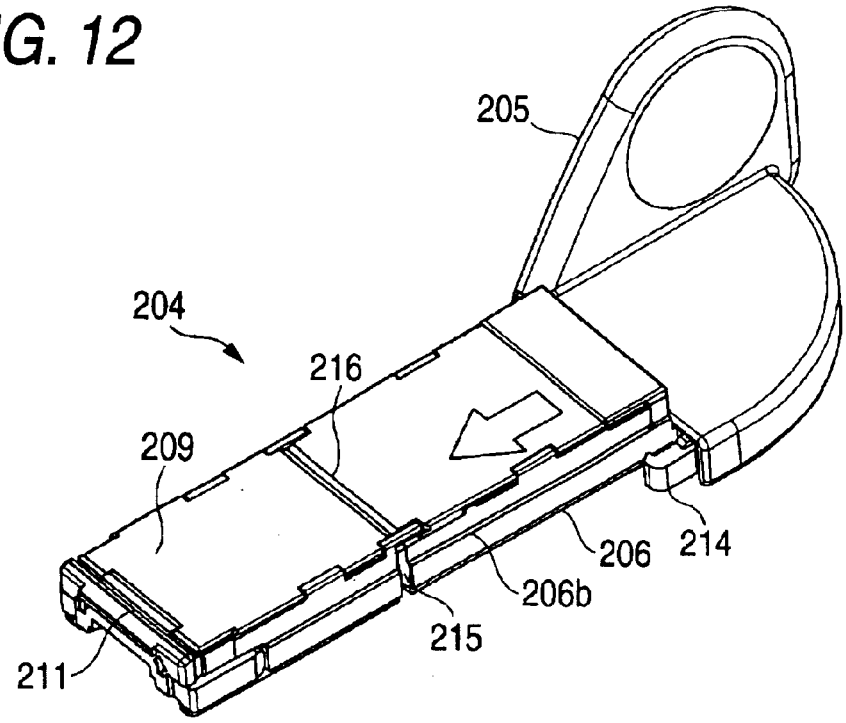
FIG. 12 is a perspective view showing an upper face side of the staple cartridge of the present invention.
Figure 13:
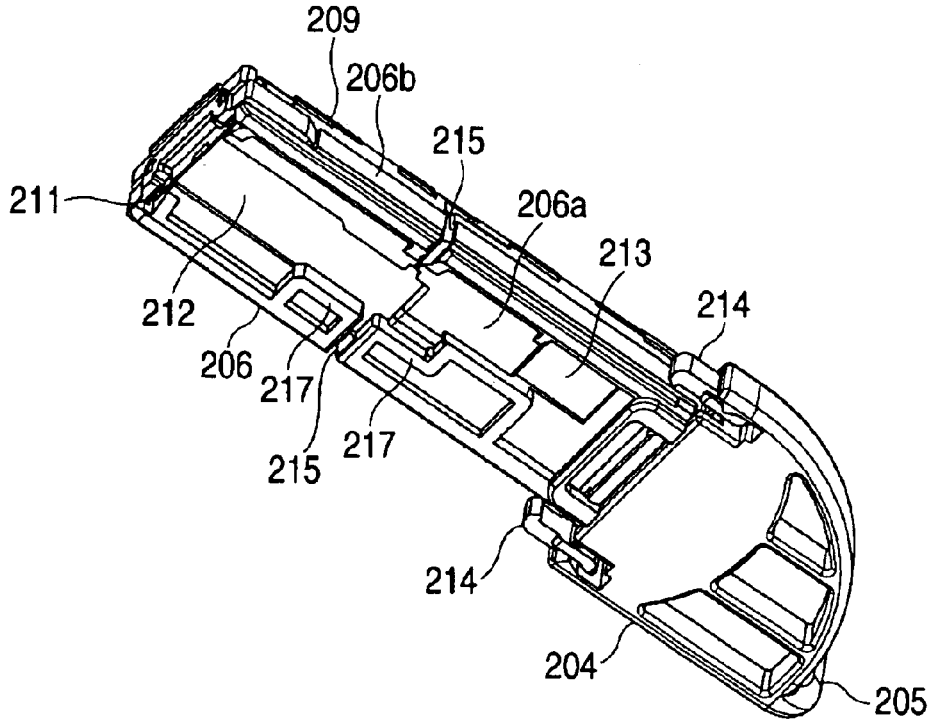
FIG. 13 is a perspective view showing a lower face side of the staple cartridge of the present invention.

In this connection, in this embodiment, the staples charged into the staple cartridge 204 are formed into a linear shape which is a shape before the staples are formed into a C-shape. The sheet staples 207 arranged in the bottom portion of the accommodating portion 210 of the cartridge body 206 are pushed by a pushing force of the spring piece 208 to the bottom portion of the cartridge body 206 and supplied to the striking passage 211, which is formed in the front end portion of the staple cartridge 204, by a supply mechanism not shown provided in the electric stapler 201. After the sheet staples 207 have been formed into a C-shape by the forming plate provided in the electric stapler 201, the sheet staples 207 are stricken out onto sheets of paper to be bound by the driver provided in the electric stapler 201. The supply mechanism for supplying the sheet staples 207 forward engages with the lower face of the sheet staples 207 in the cartridge body 206 from the opening 212 for supplying, which is formed in the bottom portion of the accommodating portion 210 of the cartridge body 206, and successively supplies the sheet staples 207 toward the striking passage 211. In this connection, reference numeral 213 is an opening for engaging the detector for detecting the existence of the sheet staples in the cartridge with the sheet staples 207. Reference numeral 214 shown in FIGS. 12 and 13 is a hook for fixing the staple cartridge 204 to the frame 202 of the electric stapler 201.

On the bottom wall 206*a* and both side walls 206*b* of the cartridge body 206, the cross section of which is a recessed shape, in which the accommodating portion 210 of the staple cartridge 204 is formed, the small thickness groove 215 is formed in such a manner that it surrounds the accommodating portion 210. As shown in FIG. 12, on the cover 209 for closing the accommodating portion 210, the small thickness groove 216 is formed in such a manner that the small thickness groove 216 surrounds the circumference of the accommodating portion 210 continuously with the small thickness groove 215. It is preferable that the thickness of the cross section of each small thickness groove 215, 216 is set at a value so that the staple cartridge 204 can be broken when the staple cartridge 204 is bent under the condition that both end portions in the longitudinal direction of the staple cartridge 204 are held with both hands. As shown in FIG. 13, in the neighborhood of the opening 212 for supplying of the bottom face 206*a* of the cartridge body 206, the reinforcing ribs 217 are formed on both sides so that the reinforcing ribs 217 can be contacted with the small thickness groove 215. Due to the above structure, the bottom wall 206*a* of the cartridge body 206 can be prevented from being deformed. Further, it is possible to prevent the occurrence of a defective supply of the staples caused by the deformation of the bottom face which is a supply face for supplying the sheet staples 207.

The staple cartridge 204, the sheet staples 207 of which have been used up, is detached from the magazine of the electric stapler 201, and the staple cartridge 204 is bent while both end portions in the longitudinal direction of the staple cartridge 204 are being held with both hands. Then, the staple cartridge 204 can be easily divided into two pieces at the small thickness grooves 215, 216. The spring piece 208 made of metal accommodated in the accommodating portion 210 can be separated from the cartridge body 206 made of plastics when the opening formed in this dividing portion is utilized. Therefore, classification for recycle or discarding can be easily carried out without using a specific tool. Further, the staples made of metal, which have not been used up, remaining in the staple cartridge 204 can be recovered and discarded being separated from the staple cartridge 204 made of plastics.

In this connection, it should be noted that the present invention is not limited to the above specific embodiment, and variations may be made without departing from the scope and spirit of the present invention. Of course, the variations are included in the present invention.

This application is based on the Japanese Patent Application (Patent Application No. 2001-253527) applied on Aug. 23, 2001 and the Japanese Patent Application (Patent Application No. 2001-253529) applied on Aug. 23, 2001. The contents of these applications are taken inhere as a reference.

INDUSTRIAL APPLICABILITY

In the staple cartridge of the present invention, the face plate 110 for forming the striking passage 111 is slidably and pivotally supported with respect to the cartridge body 106. Therefore, even when a staple is jammed in the striking passage 111, the striking passage 111 can be released by one smooth operation of sliding and turning the face plate 110. Therefore, the jammed staple can be safely and easily removed without causing an injury of a finger by the contact of the finger with the jammed staple. The support pieces 112 having the engaging boss 113 are integrally formed at both side edges of the face plate 110, and the engaging boss 113 is engaged with the recess portion 114 formed in the cartridge body 106. The structure is so simple as described above. Therefore, it is possible to provide an inexpensive staple cartridge, the manufacturing cost of which is low.

According to the present invention, the small thickness grooves 215, 216 are formed in such a manner that the small thickness grooves 215, 216 surround the accommodating portion 210 of the cartridge body 206. Therefore, the staple cartridge 204 can be divided into pieces without using any tool, and the accommodating portion 210, in which the spring piece 208 made of metal is accommodated, can be opened. Accordingly, the plastics composing the cartridge body and the metallic material composing the spring piece can be classified for recycle or discarding, which contributes to the saving of resources and the prevention of environmental pollution. Since the used staple cartridge is broken, it is possible to prevent the electric stapler from being damaged when sheet staples of out of the standard are used for the electric stapler.

What is claimed is:

1. A staple cartridge, for an electric stapler having a driver for striking a staple to sheets of paper and also having a clincher arranged opposed to the driver that bends leg portions of the staple penetrating the sheets of paper, comprising:

a cartridge body that accommodates a large number of staples, and has recess portions on both sides of a front end portion; and a face plate, having support pieces integrally formed from both side edges toward the rear, the support pieces having a boss, the face plate forming a striking passage for a staple, which is stricken out by the driver, at the front end portion of the cartridge body, wherein the staple cartridge is detachably attached to the electric stapler, and wherein the boss of the support pieces are engaged with the recess portions of the cartridge body, and the face plate is slidably and pivotally supported by the cartridge body.

2. The staple cartridge for an electric stapler according to claim 1, wherein a protruded line formed in the longitudinal direction for dividing the recess portion into the front and the rear are provided on a bottom face of the recess portion of the cartridge body.

* * * * *